US008757593B2

(12) United States Patent
Killion

(10) Patent No.: US 8,757,593 B2
(45) Date of Patent: Jun. 24, 2014

(54) RATCHET PAWL SYSTEM, DEVICE AND METHOD

(75) Inventor: Mark E. Killion, Paris, IL (US)

(73) Assignee: Commonwealth Dynamics, Inc., Portsmouth, NH (US)

( * ) Notice: Subject to any disclaimer, the term of this patent is extended or adjusted under 35 U.S.C. 154(b) by 69 days.

(21) Appl. No.: 13/468,684

(22) Filed: May 10, 2012

(65) Prior Publication Data

US 2013/0299756 A1 Nov. 14, 2013

(51) Int. Cl.
*B66F 1/04* (2006.01)

(52) U.S. Cl.
USPC ..... 254/110; 254/108; 254/109; 249/20; 249/21; 249/22

(58) Field of Classification Search
USPC ..... 254/108, 109, 110; 249/20, 21, 22
See application file for complete search history.

(56) References Cited

U.S. PATENT DOCUMENTS

| | | | | |
|---|---|---|---|---|
| 3,224,065 | A | 12/1965 | Cheskin | |
| 3,881,687 | A | 5/1975 | Johansson | |
| 3,927,865 | A | 12/1975 | Blankenburg | |
| 4,040,774 | A | 8/1977 | Scheller | |
| 4,067,448 | A | 1/1978 | Bergeron, Jr. | |
| 4,147,483 | A * | 4/1979 | Rovera et al. | 425/65 |
| 4,253,810 | A | 3/1981 | Bezhanov et al. | |
| 4,382,488 | A | 5/1983 | Anderson | |
| 4,427,181 | A | 1/1984 | Andersson | |
| 4,771,221 | A | 9/1988 | Finkbeiner | |
| 5,000,287 | A | 3/1991 | Schworer | |
| 5,575,591 | A | 11/1996 | Vanderklaauw | |
| 5,630,482 | A * | 5/1997 | Schw orer | 182/82 |
| 6,260,311 | B1 | 7/2001 | Vladikovic | |
| 6,557,817 | B2 * | 5/2003 | Waldschmitt et al. | 249/20 |
| 6,770,228 | B2 | 8/2004 | Rock | |
| 7,004,737 | B2 | 2/2006 | Russell | |
| 2003/0033772 | A1 | 2/2003 | Russell | |
| 2003/0052249 | A1 | 3/2003 | Pauley et al. | |
| 2009/0146041 | A1 | 6/2009 | Schwoerer | |

* cited by examiner

*Primary Examiner* — Lee D Wilson
*Assistant Examiner* — Shantese McDonald
(74) *Attorney, Agent, or Firm* — Peter A. Nieves; Sheehan Phinney Bass + Green PA

(57) ABSTRACT

A dual ratchet pawl jacking system, device, and method are presented for raising and/or lowering a platform bearing carriage along a vertical support. The ratchet pawls alternate supporting the weight of the carriage by engaging against a series of lugs on the vertical support. A first pawl is attached to the main frame of the carriage, and a second pawl is attached to a sub-carriage assembly that slides upward and downward within the carriage frame. A hydraulic jack applies a force upon the sub-carriage, causing the sub-carriage to move within the frame. The weight of the carriage is alternately borne by each pawl as the other pawl is relocated to a new lug. A pair of triggers is used to retract the first pawl and second pawl from the support. The triggers may be enabled to facilitate lowering the carriage, or disabled to facilitate raising the carriage.

26 Claims, 16 Drawing Sheets

RATCHET PAWL SYSTEM, DEVICE AND METHOD

FIELD OF THE INVENTION

The present invention relates to ratchet devices, and more particularly, is related to an ascending and descending jacking system.

BACKGROUND OF THE INVENTION

Concrete casting techniques may utilize spaced forms held in position by supports movable up a wall under construction. Concrete is poured between the forms and on top of earlier formed sections of the wall. Examples of construction using such techniques include cooling towers and smokestacks. Prior art jacking systems are primarily concerned with ascending, where the movable rig is raised until the structure is constructed, and then the rig is disassembled for removal.

In general, a dual pawl system may raise a carriage along a vertical support. Two pawls alternate supporting the weight of the carriage by engaging against a series of protruding or recessed lugs evenly spaced upon the vertical support. As a force is applied to the carriage, the weight of the carriage is alternately borne by one pawl as the other pawl is relocated to a new lug located immediately above the previous lug as the carriage is raised.

An example of a prior art ascending jacking system is shown by FIG. 1A. A platform bearing carriage 100 ascends a vertical support 170 as concrete forms are poured and installed. FIG. 1B shows a detail of the jacking system of the prior art carriage 100. Generally, a lower pawl assembly 130 and an upper pawl assembly 120 alternately support the weight of the carriage 100 upon a plurality of lugs 175 spaced along the vertical support 170 as the carriage ascends. A hydraulic jack 110 extends and retracts a plunger 115 attached to the upper pawl assembly 120. As the plunger extends, the upper pawl assembly 120 is engaged with a lug 175, bearing the weight of the carriage 100 as weight is relieved from the lower pawl assembly 130, allowing the lower pawl assembly to ascend. The spring loaded lower pawl assembly 130 retracts slightly as it passes over a lug 175, and then is forced against the vertical support 170 as the lower pawl assembly 130 clears the lug 175. Similarly, as the hydraulic jack 110 retracts the plunger 115, the lower pawl assembly 130 supports the carriage 100 as the upper pawl assembly 120 is raised.

The prior art carriage 100 is only configured to ascend the vertical support 170. A typical concrete pouring system may incorporate multiple carriages to simultaneously support and raise a number of platforms. However, ascending only jacks are not generally practical for maintenance, repair, or rebuilding of structures, for example, smokestacks and cooling towers, because they cannot easily be moved to lower positions. While some prior art jacking systems are capable of descending, they do not do so easily or automatically. In particular, descent may require manual releasing of individual supports, but it is generally impractical to release multiple supports simultaneously.

Therefore, there is a demonstrated need in the industry for a jacking system that addresses some or all of these deficiencies.

SUMMARY OF THE INVENTION

Embodiments of the present invention provide a ratchet pawl system, device and method. Briefly described, a first aspect of the present invention is directed to a method for lowering a carriage configured to ascend and descend along a support having a series of lugs disposed upon the support. Each lug has a top edge and a bottom edge. The carriage includes a frame with a first ratchet pawl configured to engage the top edges of the series of lugs, a sub-carriage slidably disposed within the frame including a second ratchet pawl configured to engage the top edges of the series of lugs, and a plunger configured to apply a downward force upon the sub-carriage. The method includes the steps of engaging the first ratchet pawl with a first lug, supporting a weight of the carriage with the first ratchet pawl, retracting the second ratchet pawl from the support, applying a downward force upon the sub-carriage, causing the sub-carriage to descend with respect to the frame, engaging the second ratchet pawl upon a second lug, transferring the weight of the carriage to the second ratchet pawl, disengaging the first ratchet pawl from the first lug, retracting the first ratchet pawl away from the support, relaxing the downward force upon the sub-carriage, thereby lowering the frame, and engaging the first ratchet pawl with a third lug, wherein the third lug is disposed below the first lug.

The method may further include the step of applying an upward force to a finger pawl attached to the sub-carriage, wherein the finger pawl is configured to engage a bottom edge one of the series of lugs.

A second aspect of the present invention is directed to a method for lowering a carriage configured to ascend and descend along a support having a series of lugs disposed upon the support, each lug having a top edge and a bottom edge. The carriage includes a sub-carriage slidably disposed within the carriage. The method includes the steps of engaging the carriage with a first lug top edge, supporting a weight of the carriage upon the first lug top edge, applying a downward force to the sub-carriage, causing the sub-carriage to descend with respect to the carriage, engaging the sub-carriage with a second lug top edge, transferring the weight of the carriage from the first lug to the second lug, and relaxing the downward force upon the sub-carriage, thereby lowering the carriage with respect to the sub-carriage.

Additional steps under the method of the second aspect may include releasing the carriage from the first lug top edge, engaging the carriage with a third lug top edge, wherein the third lug is disposed below the first lug, and releasing the sub-carriage from the second lug top edge. An optional step includes engaging the sub-carriage with the bottom edge of a lug selected from the group consisting of the first lug, the second lug, the third lug, and a fourth lug. An optional step includes releasing the sub-carriage from the bottom edge of the selected lug.

Briefly described, a third aspect of the present invention is directed to a method for raising or lowering a load bearing carriage along a support having a series of lugs disposed upon the support, the carriage having a first pawl configured to retractably engage the series of lugs, and a sub-carriage slidably disposed within the carriage including a second pawl configured to retractably engage the series of lugs. The method includes the steps of applying a variable magnitude unidirectional force upon the sub-carriage, and configuring the carriage for a descending mode. Configuring the carriage for a descending mode includes setting a first trigger causing the first pawl to retract from the support, setting a second trigger causing the second pawl to retract from the support, and configuring the first trigger and the second trigger to trip based on the location of the sub-carriage relative to the carriage.

Under the third aspect, the first trigger may be tripped when the sub-carriage is at a first location relative to the carriage, and the second trigger may be tripped when the sub-carriage is at a second location relative to the carriage. A step may include configuring the carriage for an ascending mode by clearing the first trigger and the second trigger. The force may be applied by a hydraulic jack, and the force may be applied in a substantially parallel and/or opposite direction to a carriage direction of travel.

Briefly described, in architecture, a fourth aspect of the present invention is directed to a carriage configured to ascend and descend along a substantially vertical support having a series of lugs disposed upon the vertical support, each lug of the series of lugs having a top edge and a bottom edge. The carriage includes a frame having a first movable support configured to engage the top edges of the series of lugs, a sub-carriage slidably disposed within the frame having a second movable support configured to engage the top edges of the series of lugs, a first trigger for retracting the first movable support from the series of lugs, a second trigger for retracting the second movable support from the series of lugs, and a member configured to apply a unidirectional force upon the sub-carriage.

The first movable support may include a first ratchet pawl, and the second movable support may include a second ratchet pawl. The first trigger and the second trigger may be configured to be selectively activated. The member may be a hydraulic jack. The first trigger and the second trigger may include a first trip bar attached to the sub-carriage configured to retract the first ratchet pawl from the series of lugs, and a second trip bar attached to the frame configured to retract the second ratchet pawl from the series of lugs. The first trigger and the second trigger may further include a first ratchet pawl ear piece configured to engage with the first trip bar, and a second ratchet pawl ear piece configured to engage with the second trip bar, wherein the first ratchet pawl ear piece is disposed upon the first ratchet pawl, and the second ratchet pawl ear piece is disposed upon the second ratchet pawl.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principals of the invention.

DETAILED DESCRIPTION

Figure 1A:
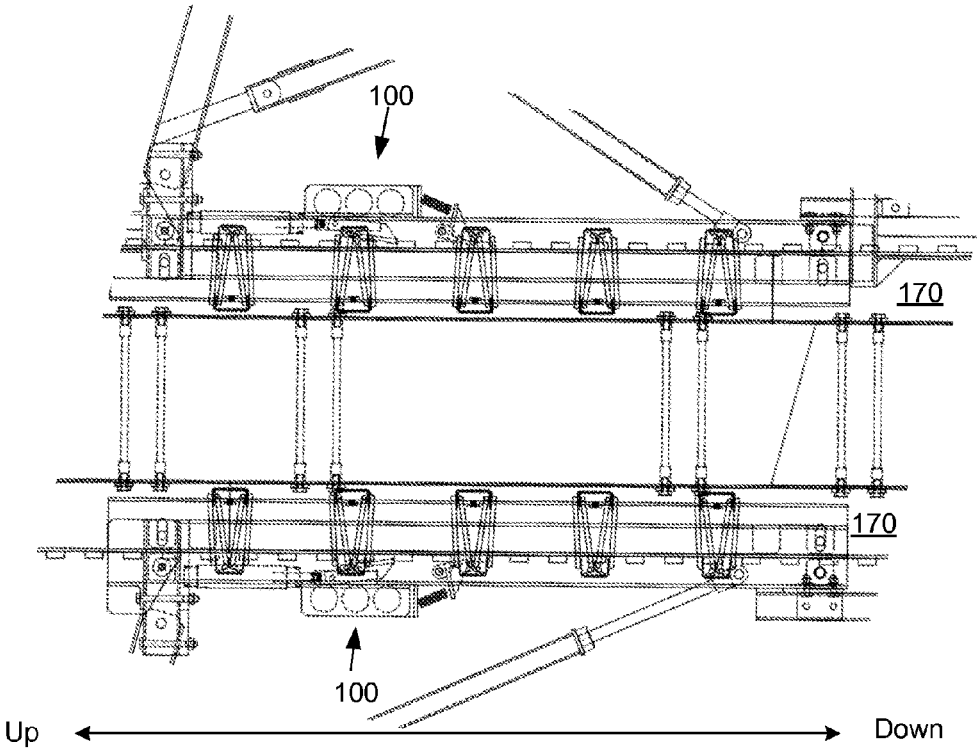
FIG. 1A (PRIOR ART)
FIG. 1A is a schematic diagram of a prior art ascending only jacking system.
Figure 1B:
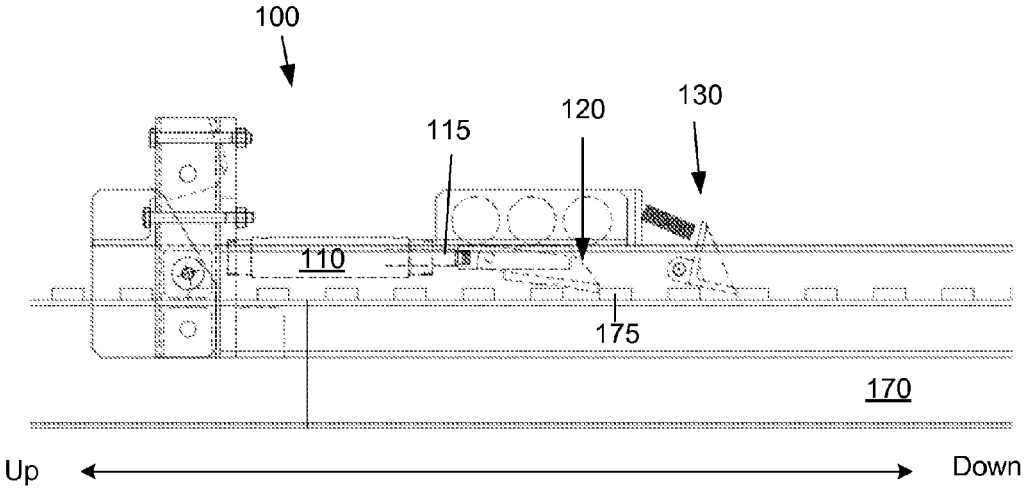
FIG. 1B (PRIOR ART)
FIG. 1B is a schematic diagram of a prior art ascending only jacking system detail.

Reference will now be made in detail to embodiments of the present invention, examples of which are illustrated in the accompanying drawings. Wherever possible, the same reference numbers are used in the drawings and the description to refer to the same or like parts.

In general, embodiments of a dual ratchet pawl jacking system may be used to raise or lower a platform bearing carriage along a support, for example, a vertical support. Two ratchet pawls alternate supporting the weight of the carriage by engaging against a series of lugs evenly spaced upon the vertical support. A lower pawl is attached to the main frame of the carriage, and an upper pawl is attached to a sub-carriage assembly that slides upward and downward within the carriage frame. A hydraulic jack applies a force upon the sub-carriage, causing the sub-carriage to move within the frame. The weight of the carriage is alternately borne by each pawl as the other pawl is disengaged and relocated to a new lug located immediately above or below the previous lug. A pair of triggers is used to retract the upper pawl and lower pawl from the support and allow the pawls to clear a lower adjacent lug when the carriage is descending. The triggers may be enabled to facilitate lowering the carriage, or disabled to facilitate raising the carriage with substantially the same application of force upon the sub-carriage.

While the embodiments described below generally describe a single carriage system, a jacking system may consist of two or more carriages working together, for example, with the hydraulic jacks of each of the carriages operating substantially in concert.

First Embodiment

Figure 2:
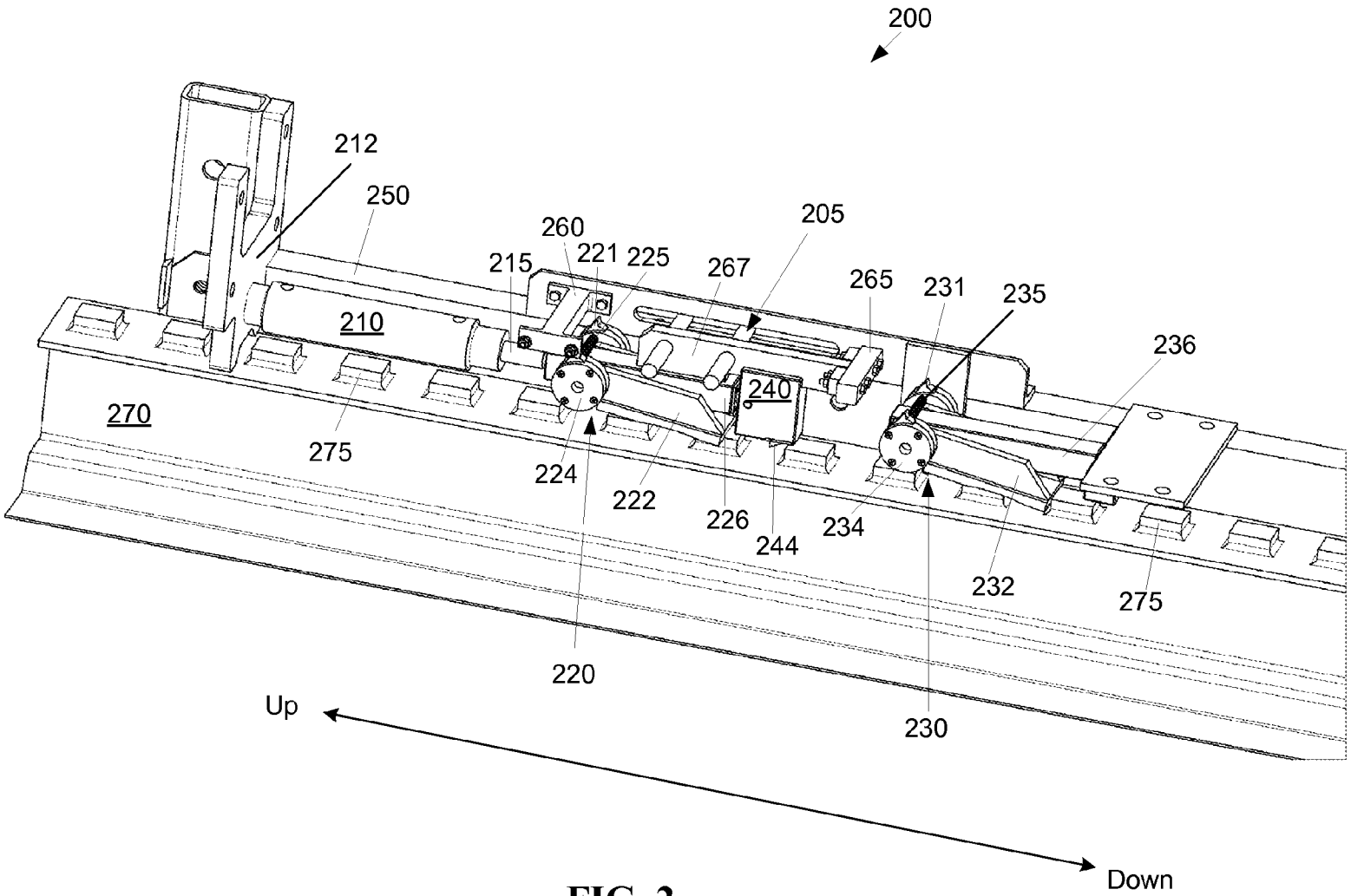
FIG. 2 is a schematic diagram of the first embodiment of a ratchet pawl system.
Figure 3A:
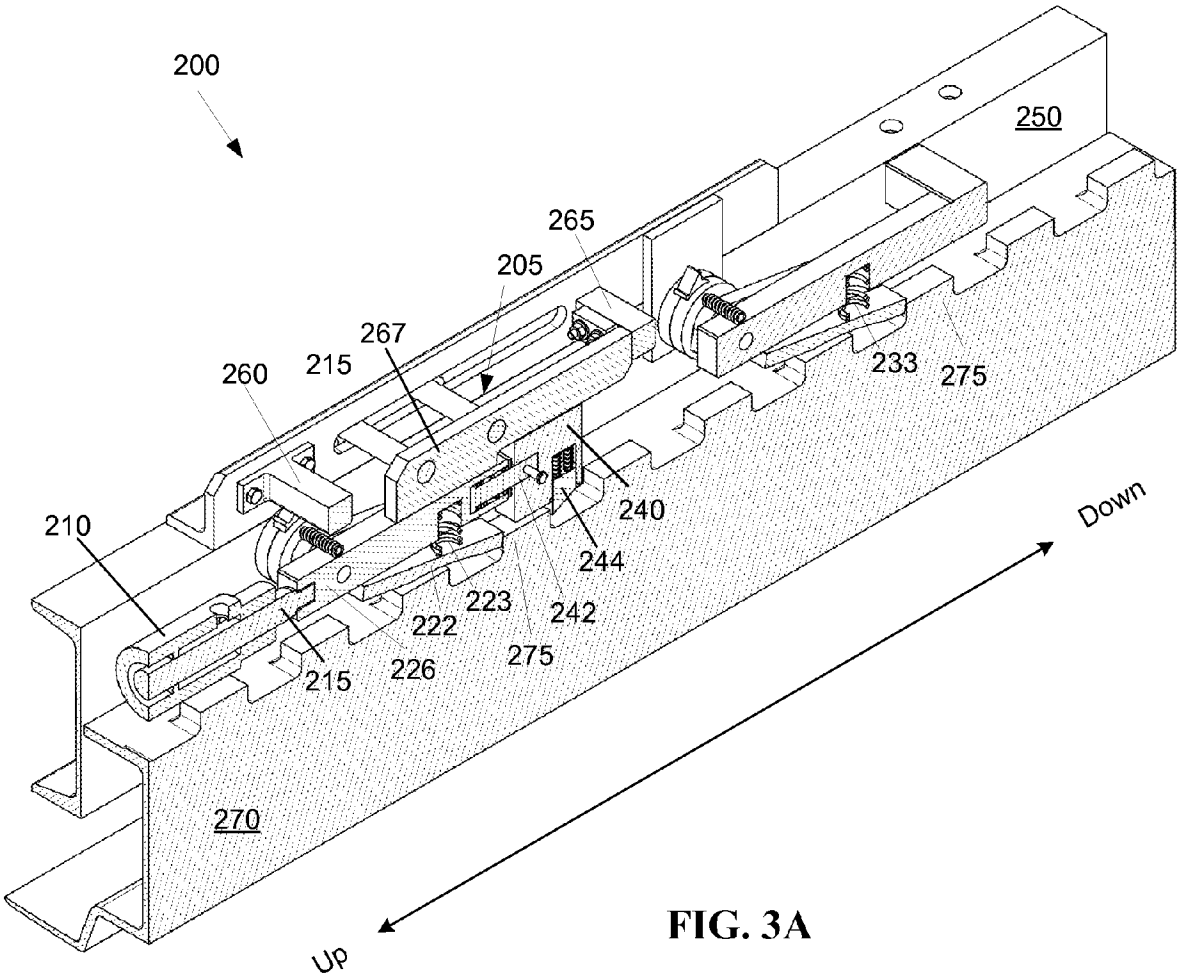
FIG. 3A is a cutaway schematic diagram of the first embodiment of a ratchet pawl system.
Figure 3B:
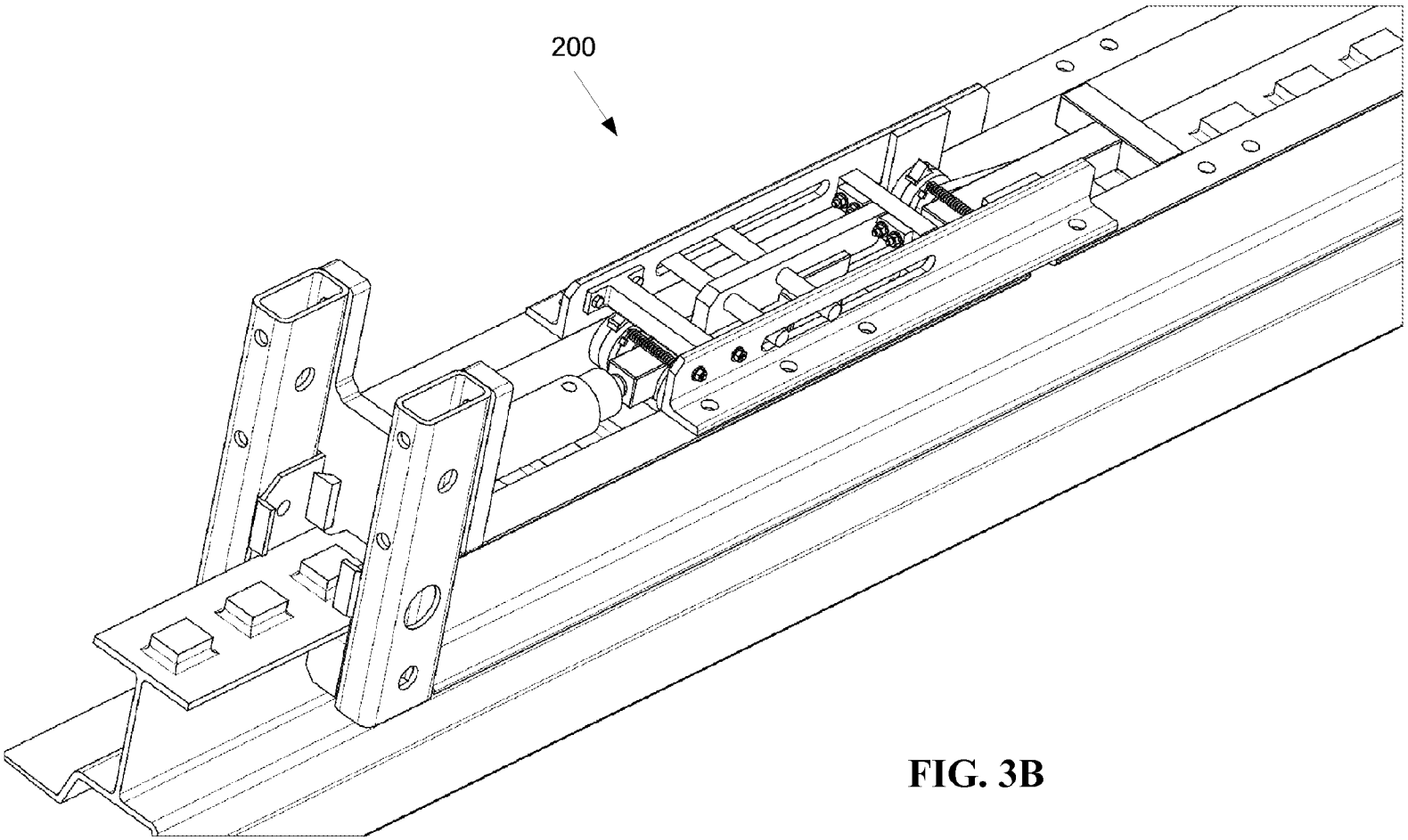
FIG. 3B is a schematic diagram of the first embodiment of a ratchet pawl system engaged with a vertical support.

A first exemplary embodiment of a ratchet pawl system of the present invention, as shown by FIG. 2, includes a carriage 200 that moves along a vertical support 270. The vertical support 270 has a series of protruding jacking lugs 275. The carriage 200 is used to raise or lower a load, for example, a platform bearing concrete forms. The carriage includes a frame 250 having a lower ratchet pawl assembly 230 affixed to the frame 250, and an upper ratchet pawl assembly 220, affixed to a sub-carriage 205 that slidably moves within the frame 250. The ratchet pawl assemblies 220, 230 include upper and lower ratchet pawls 222, 232 that engage with the top edges of the lugs 275 under force toward the vertical support 270 from upper and lower ratchet pawl internal springs 223, 233 (FIG. 3A). The ratchet pawl assemblies 220, 230 alternately support the weight of the carriage 200 and associated platform (not shown). It should be noted that while the first embodiment portrays the lugs 275 as blocks protruding outward from the vertical support 270, there is no objection to implementing the lugs 275 as a series of recesses in the vertical support 270, where the ratchet pawls 222, 232 are configured to engage within the recesses.

A fundamental difference between an ascending mode and a descending mode for the carriage 200 is that in the ascending mode there is no need for a separate mechanism to disengage and retract the ratchet pawls 222, 232 from the lugs 275. Upward force upon the carriage or sub-carriage 205 disengages the ratchet pawls 222, 232 from the lugs 275 as the carriage or sub-carriage 205 is raised, and the ratchet pawls 222, 232 clear the immediately adjacent lugs 275 by retracting and sliding over the lugs as they come into contact. In contrast, in the descending mode, each ratchet pawl 222, 232 must be alternately raised slightly to disengage the lug 275 it was engaged with, and then retracted away from the vertical support 270 by an external means in order to clear the lug 275 as the pawl descends past the lug 275. As described below, under the first embodiment, the ratchet pawl assembly 220, 230 may be retracted by a spring mechanism that rotates the ratchet pawl 222, 232 away from the vertical support 270. However, in alternative embodiments the ratchet pawls 222, 232 may be retracted by other means familiar to persons having ordinary skill in the art, for example, hydraulics, and/or servo motors in place of and/or in addition to the ratchet pawl internal springs 223, 233.

Figure 3C:
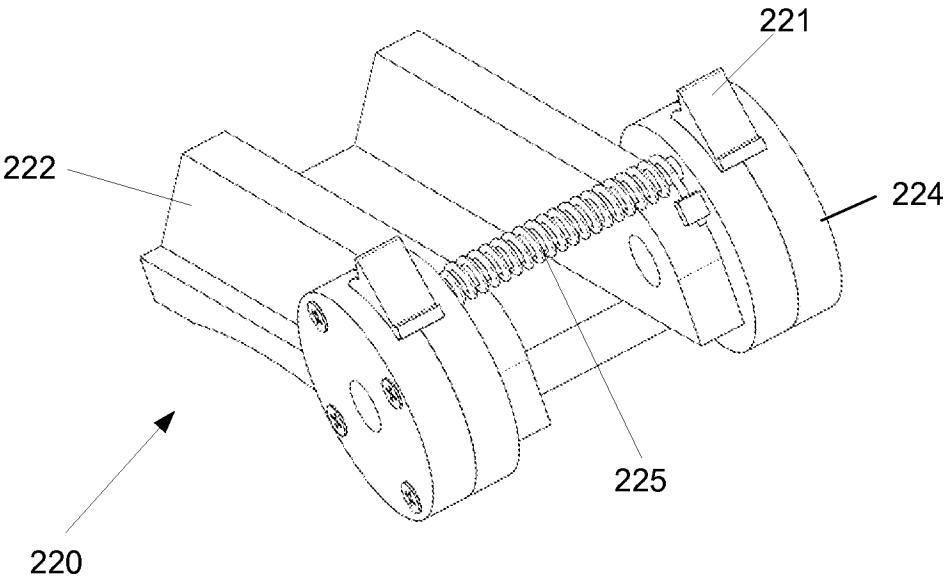
FIG. 3C is a schematic diagram detailing a ratchet pawl assembly.

The ratchet pawl assemblies 220, 230 include upper and lower ratchet pawl supports 226, 236, and attached ratchet pawl rotors 224, 234 that may be rotated to disengage the ratchet pawls 222, 223 from the lugs 275. The ratchet pawl rotors 224, 234 each have at least one rotating ear piece 221, 231 under tension from ratchet pawl torsion springs 225, 235. Either ratchet pawl 222, 232 may be disengaged from the lugs 275 by applying a force to the rotating ear pieces 221, 231, thereby rotating the ratchet pawl rotors 224, 234 and retracting the ratchet pawls 222, 232 from the lugs 275. The force may be applied to the upper rotating ear piece 221, for example, by an upper trip bar 260. Similarly, the force may be applied to the lower rotating ear piece 231, for example, by a lower trip bar 265. Elements of the upper ratchet pawl assembly are shown isolated from the carriage 200 in FIG. 3C. The lower ratchet pawl assembly may be substantially similar to the upper ratchet pawl assembly.

Returning to FIG. 2, a hydraulic jack 210 is attached to the frame 250 at a hydraulic jack support 212. The hydraulic jack 210 has a hydraulic jack plunger 215 that is connected to the upper ratchet pawl assembly 220, for example, by screwing the threaded end of the hydraulic jack plunger 215 into a threaded receptacle of an upper ratchet pawl support 226. The hydraulic jack 210 applies a variable magnitude unidirectional force upon the sub-carriage as the hydraulic jack plunger 215 extends and retracts. The upper ratchet pawl assembly 220 is attached to a lower trip bar carrier 267, and the upper ratchet pawl assembly 220 and the lower trip bar carrier 267 are part of the sub-carriage 205 that slidably moves within the frame 250, under force from the hydraulic jack 210. While under the first embodiment a hydraulic jack 210 is used to apply downward force to the sub-carriage 205, there is no objection to alternative embodiments where downward force is applied to the sub-carriage 205 by other means, for example, springs or a motor controlled rack and pinion.

FIG. 3A shows a finger pawl block 240 is connected to the upper ratchet pawl support 226 by a finger pawl plunger 242 inserted into a cylindrical aperture at the bottom end of the upper ratchet pawl support 226. The finger pawl plunger 242 is held within the upper ratchet pawl support 226 by a spring, and may extend outward from the upper ratchet pawl support 226 under force. A spring loaded door latch 244 protrudes from the finger pawl block 240. The spring loaded door latch 244 engages with the lower edge of lugs 275, and allows the finger pawl block 240 to slide past the top edge and outer surface of the lugs 275 when the frame 250 is descending. The finger pawl block 240 may be used to latch onto a bottom edge of a lug 275 and exert an additional downward force, as supplied by the hydraulic jack 210, for example, if the carriage 200 encounters any resistance in its descent that cannot be overcome by gravity alone. Such resistance may be caused by, for example, splattered concrete that has dried in the transport path of the carriage 200. Another example of when the force of gravity may be insufficient to cause the carriage 200 to descend is when the jacking system is not vertically oriented, for example, in a horizontal orientation, or any other orientation between horizontal and vertical, such as a 45 degree orientation. It should be noted that there is no objection to embodiments of the jacking system where the finger pawl block 240 is absent.

By removing or relocating the trip bars 260, 265 and removing the finger pawl block 240, the jacking system may be converted from descending mode to ascending mode. By replacing the finger pawl block 240 and replacing or relocating the trip bars 260, 265, the jacking system may be converted from ascending mode to descending mode. For example, to place the carriage 200 in the ascending mode, the trip bars 260, 265 may be loosened and moved slightly away from the vertical support 270 such that the pawl ear pieces 221, 231 do not make contact with the trip bars 260, 265. Under the first embodiment removing or relocating the finger pawl block 240 may be needed for unrestricted motion of the sub-carriage 205 in ascending mode.

Alternatively, the finger pawl spring loaded door latch 244 may be retracted within the finger pawl block 240 to prevent it from engaging with the lugs 270, and allowing the carriage to ascend. Similarly, the trip bars 260, 265 may be left in place, and the pawl ear pieces 221, 231 may be retracted or removed to prevent engagement with the trip bars 260, 265 so that the ratchet pawls 222, 232 are not retracted from the vertical support 270.

It should be noted that while under the first embodiment the finger pawl block 240 is positioned between the upper ratchet pawl assembly 220 and the lower ratchet pawl assembly 230, there is no objection to embodiments where the finger pawl block 240 is positioned above the upper ratchet pawl assembly 220, or below the lower ratchet pawl assembly 230. In such embodiments, it may not be necessary to remove and/or relocate the finger pawl block 240 in ascending mode.

Second Embodiment

Under a second exemplary embodiment of a ratchet pawl system of the present invention, a carriage includes a frame and a sub-carriage slidably disposed within the frame. The second embodiment is essentially similar to the first embodiment, except a pawl assembly that is affixed to the frame is disposed above a pawl assembly that is affixed to the sub-carriage. As with the first embodiment, a finger pawl block may be disposed above, below, or between the two ratchet pawl assemblies.

Method

Figure 4:
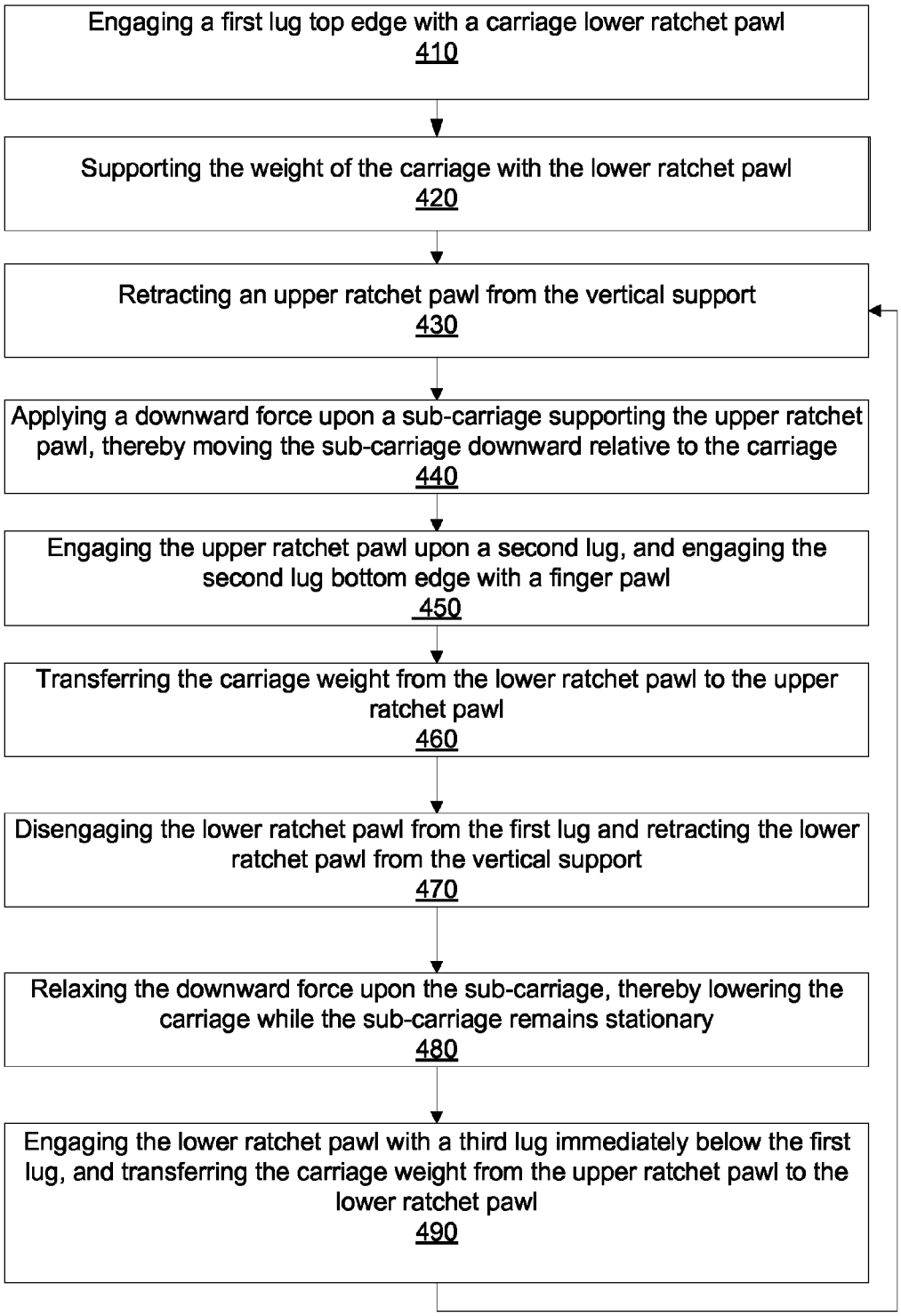
FIG. 4 is a flowchart of method for lowering a carriage supported by the dual ratchet pawl jacking system.
Figure 5:
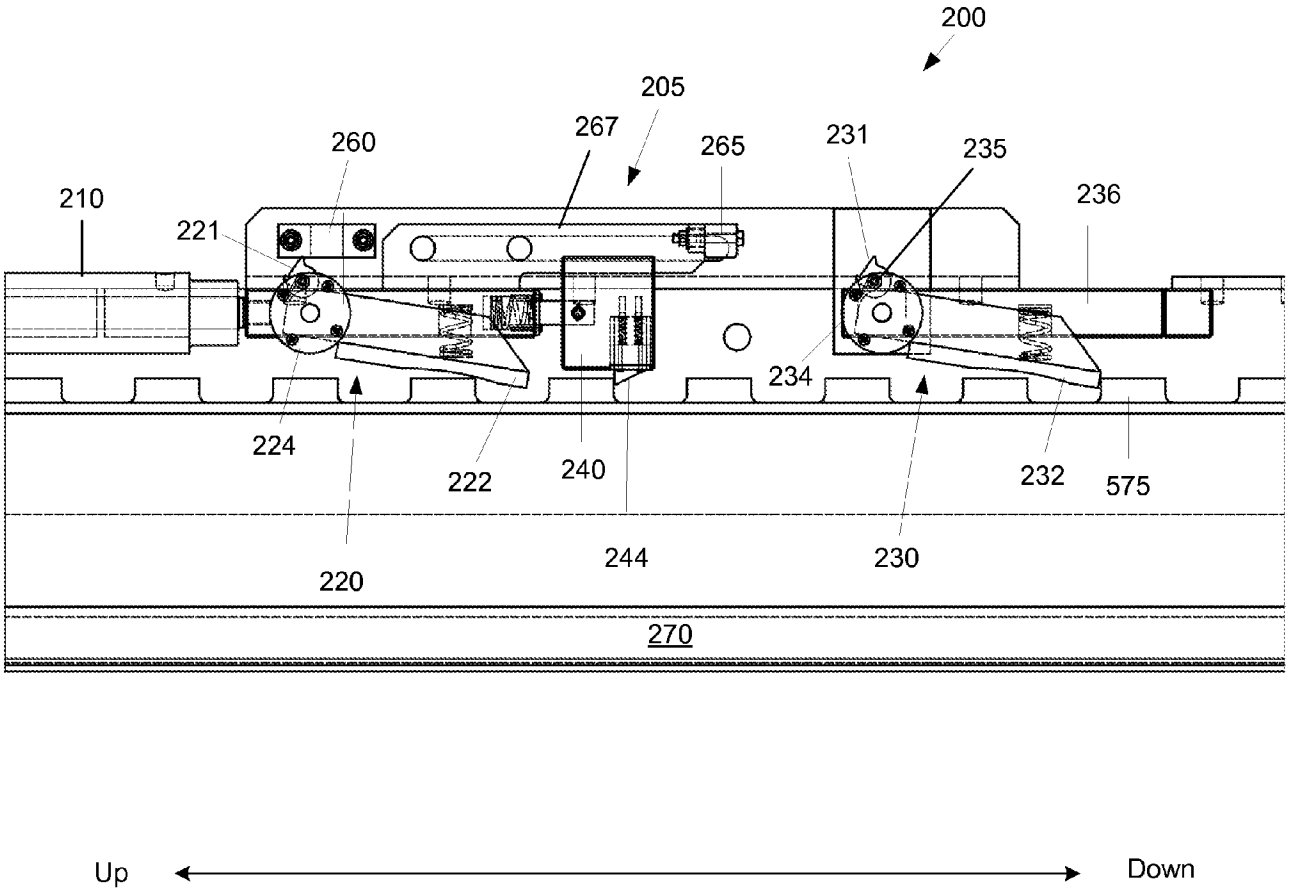
FIGS. 5-13 are sequential schematic diagrams of the dual ratchet pawl jacking system as the carriage is descending.
Figure 6:
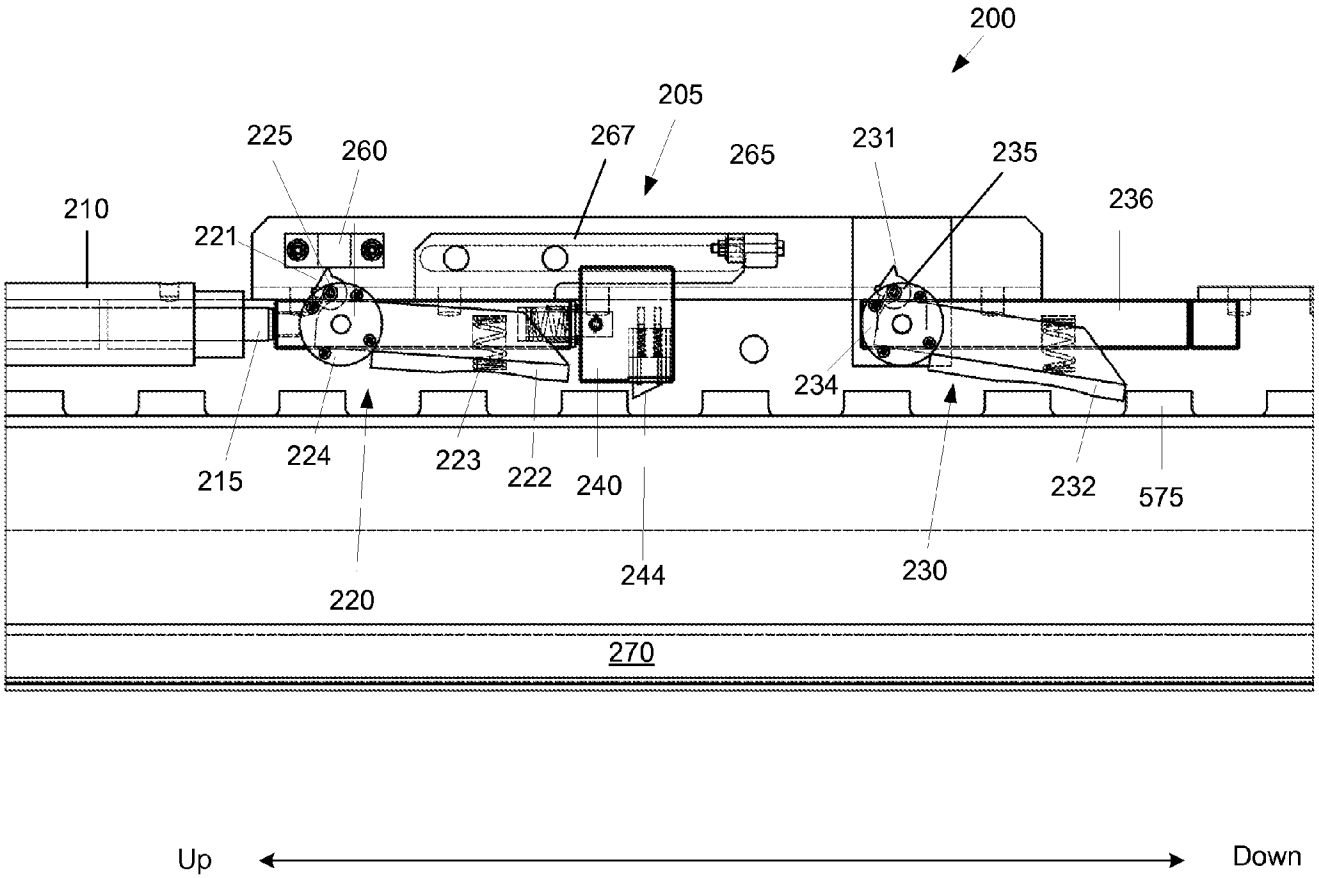
Figure 7:
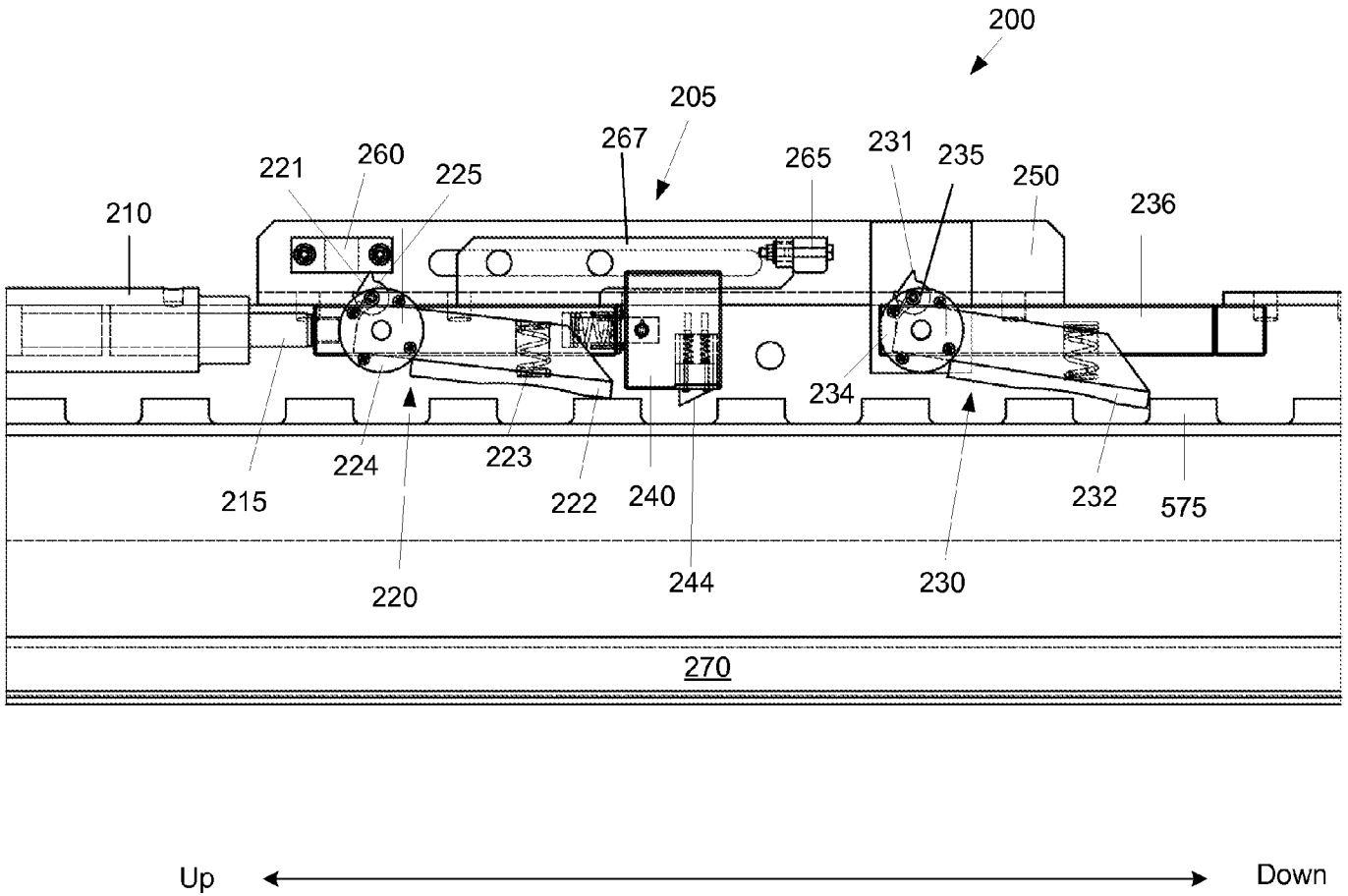

FIG. 4 is a flowchart depicting a first embodiment of a method for lowering a carriage supported by the dual ratchet pawl jacking system embodiments described above. A step includes engaging a first lug 575 (FIG. 5) top edge with a carriage lower ratchet pawl, as shown in block 410. The weight of the carriage is supported by the lower ratchet pawl, as shown in block 420. FIG. 5 shows the carriage 200 being supported by the lower ratchet pawl 232 as engaged upon the first lug 575. Returning to FIG. 4, the extending hydraulic jack plunger 215 exerts a downward force upon the sub-carriage 205 supporting the upper ratchet pawl assembly 220, thereby moving sub-carriage 205 downward relative to the carriage 200, as shown in block 430. FIG. 6 shows the downward movement of the sub-carriage 205 causing the upper ratchet pawl ear piece 221 to engage the upper trip bar 260. This compresses the upper ratchet pawl internal spring 223, causing the upper ratchet pawl rotor 224 to rotate and retract the upper pawl 222 away from the vertical support 270, as shown in block 440 (see FIG. 4). FIG. 7 shows the sub-carriage 205 continuing to descend relative to the frame 250. As the upper ratchet pawl ear piece 221 clears the upper trip bar 260, the upper ratchet pawl internal spring 223 re-engages, forcing the upper ratchet pawl 222 to rotate toward the vertical support 270.

Figure 8:
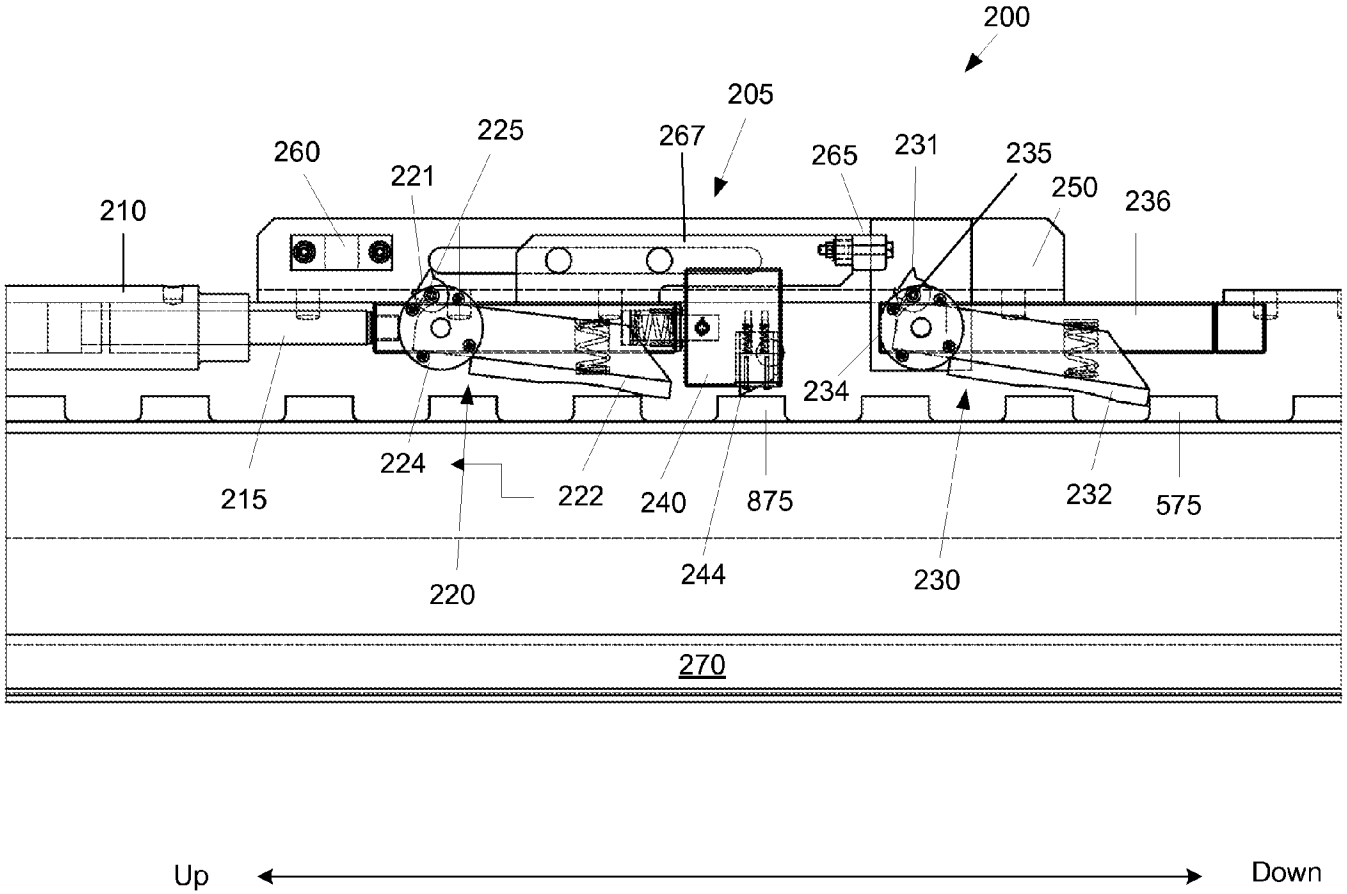
Figure 9:
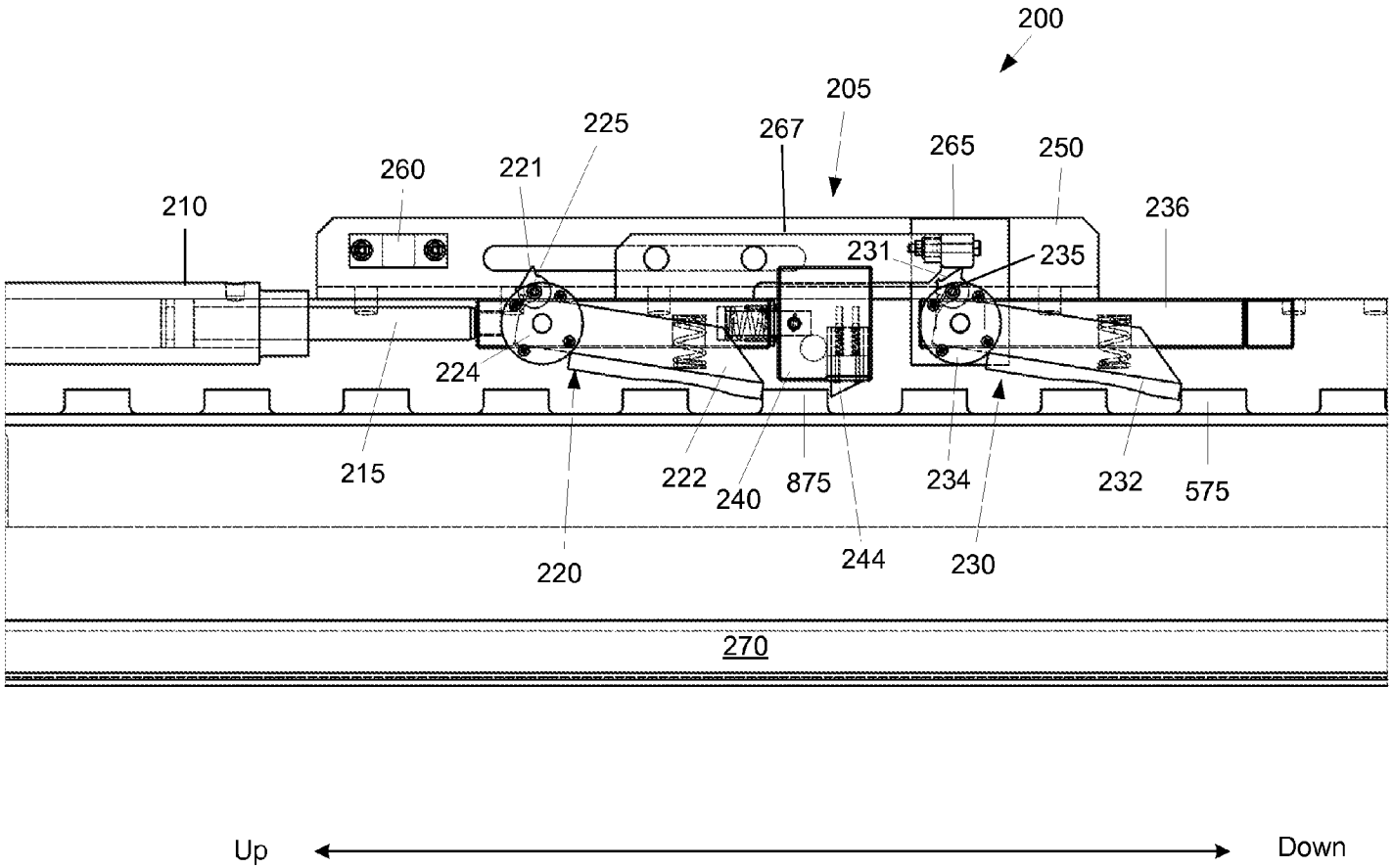

FIG. 8 shows the sub-carriage 205 continuing to descend as the hydraulic jack plunger 215 continues to extend. The finger pawl spring loaded door latch 244 retracts as it encounters a second lug 875. FIG. 9 shows the sub-carriage 205 coming to a rest as the upper ratchet pawl 222 rotates fully to a weight bearing position and engages the top edge of the second lug 875, and the finger pawl 240 engages the second lug 875 bottom edge, as shown in block 450 (FIG. 4). The carriage weight transfers from the lower ratchet pawl 232 to the upper ratchet pawl 222, as shown in block 460 (FIG. 4). The lower trip bar 265 that has been descending with the sub-carriage 205 strikes the lower ratchet pawl ear piece 231, causing the lower ratchet pawl ear piece 231 to retract into the lower ratchet pawl rotor 224, thereby compressing the lower ratchet torsion spring 225. It should be noted that while the ear piece on the pawl is retractable in the above example, other similar mechanisms may be used to withdraw the pawl from the vertical support. For example, in an alternative embodiment, a pawl ear piece may be fixed to the pawl hub, and triggered to engage or withdraw from the vertical support by, for example, spring loaded rotational trip bars with either tension or compression springs or a torsion spring around a connector rod.

Figure 10:
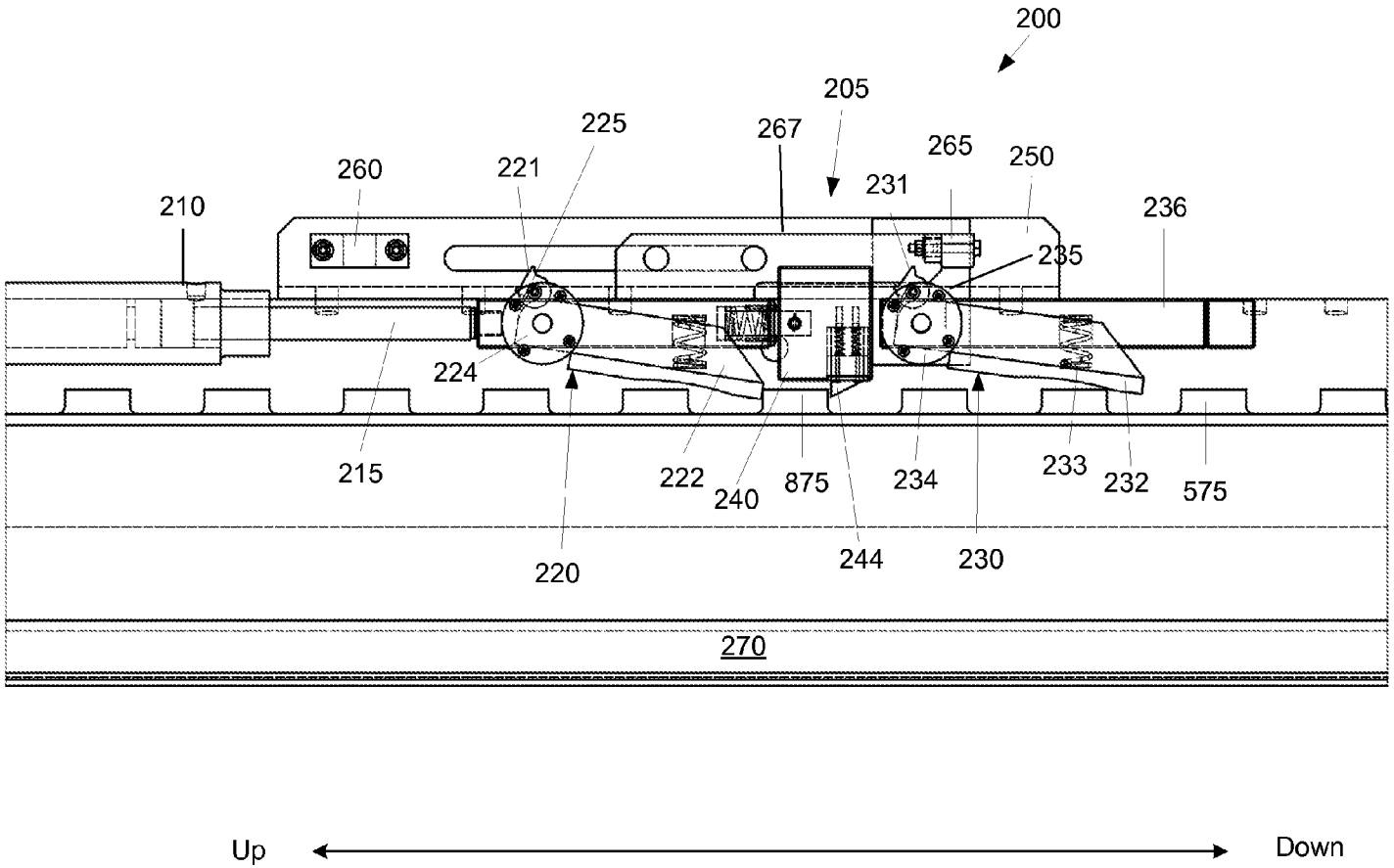

FIG. 10 shows the jack plunger 215 continuing to extend to its fullest extension, raising the frame 250 slightly. The finger pawl 240 remains in close proximity to the second lug 875. The lower ratchet pawl ear piece 231 clears the lower trip bar 265 and the lower ratchet pawl ear piece 231 snaps open. Disengaging the lower ratchet pawl 232 from the first lug 575 and retracting the lower ratchet pawl from the vertical support is shown by block 470 (FIG. 4).

Figure 11:
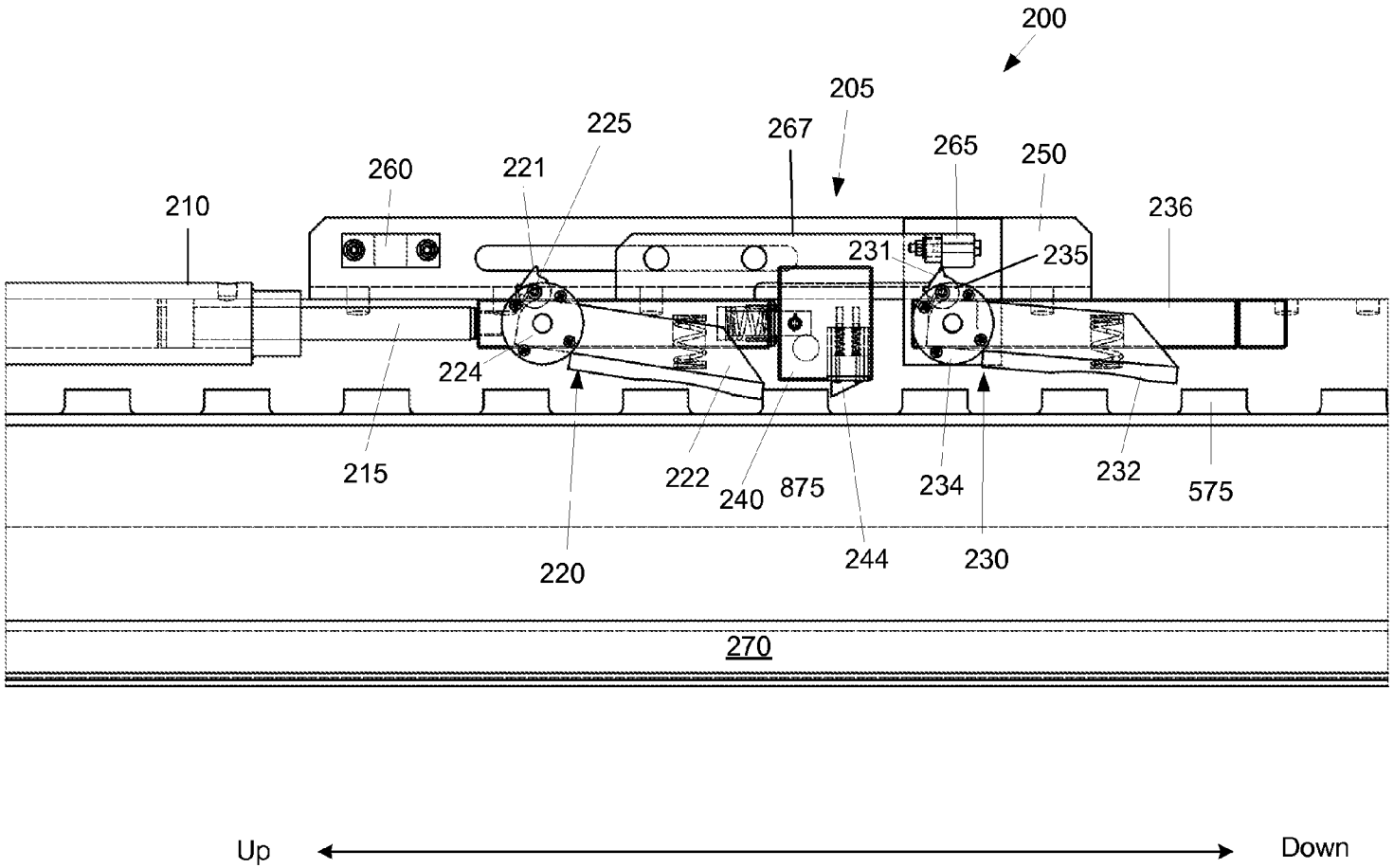

FIG. 11 shows the jack plunger 215 as it begins to retract into the hydraulic jack 210, relaxing the downward force upon the sub-carriage 205, thereby lowering the carriage 200 while the sub-carriage 205 remains stationary. This is shown by block 480 (FIG. 4). As the lower ratchet pawl assembly 230 moves downward with the frame 250, the lower ratchet pawl ear piece 231 strikes the lower trip bar 265, again retracting the lower ratchet pawl 232 from the vertical support 270, allowing the lower ratchet pawl 232 to clear the first lug 575 as the carriage 200 and frame 250 descend.

Figure 12:
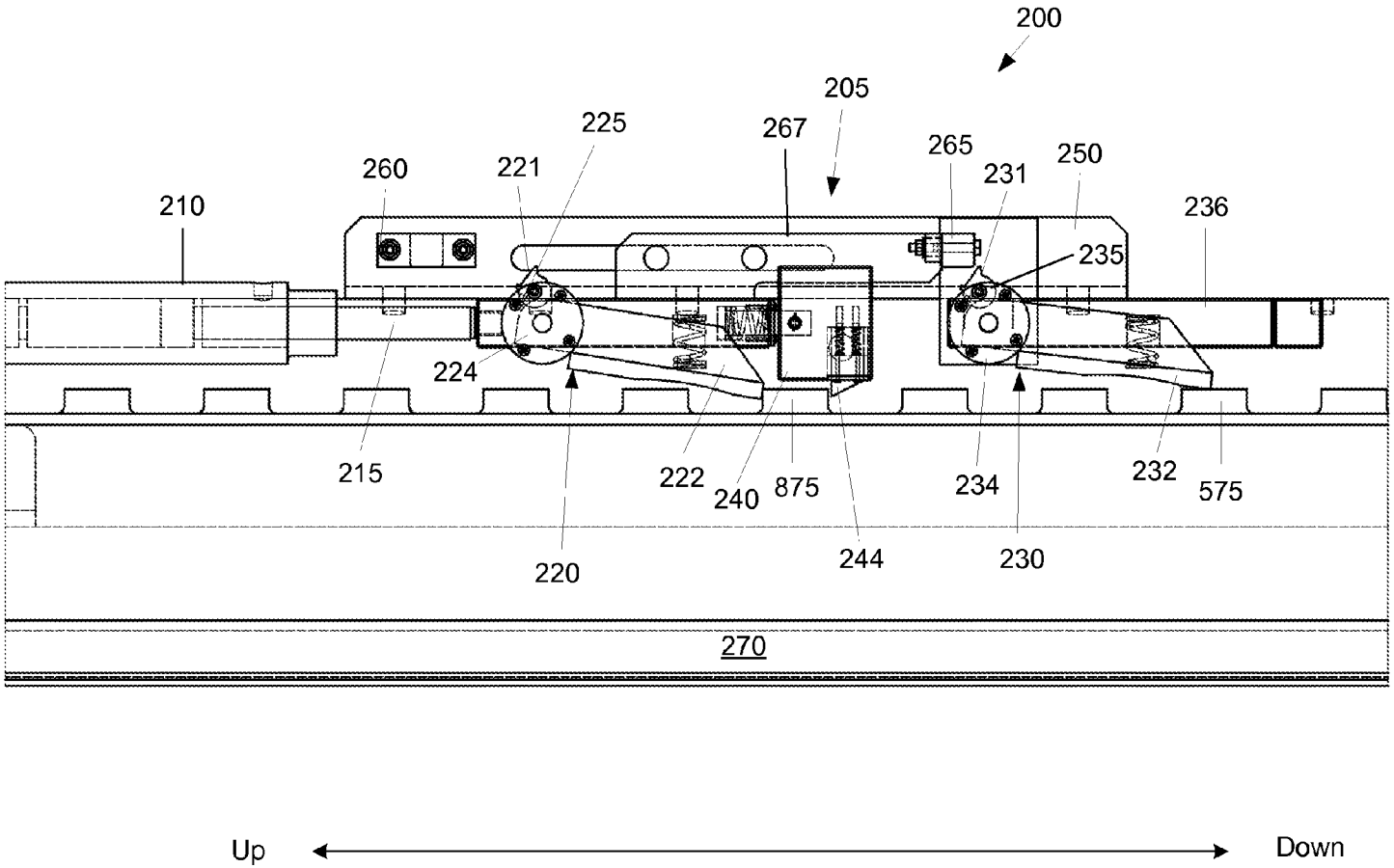

FIG. 12 shows the jack plunger 215 as it continues to retract, and the frame 250 continues to descend, and the lower ratchet pawl ear piece 231 clears the lower trip bar 265, causing the lower pawl rotor 234 to rotate and force the lower ratchet pawl 232 toward the vertical support 270. In particular, FIG. 12 shows the lower ratchet pawl sliding against the vertical surface of the first lug 575 as the frame 250 descends.

Figure 13:
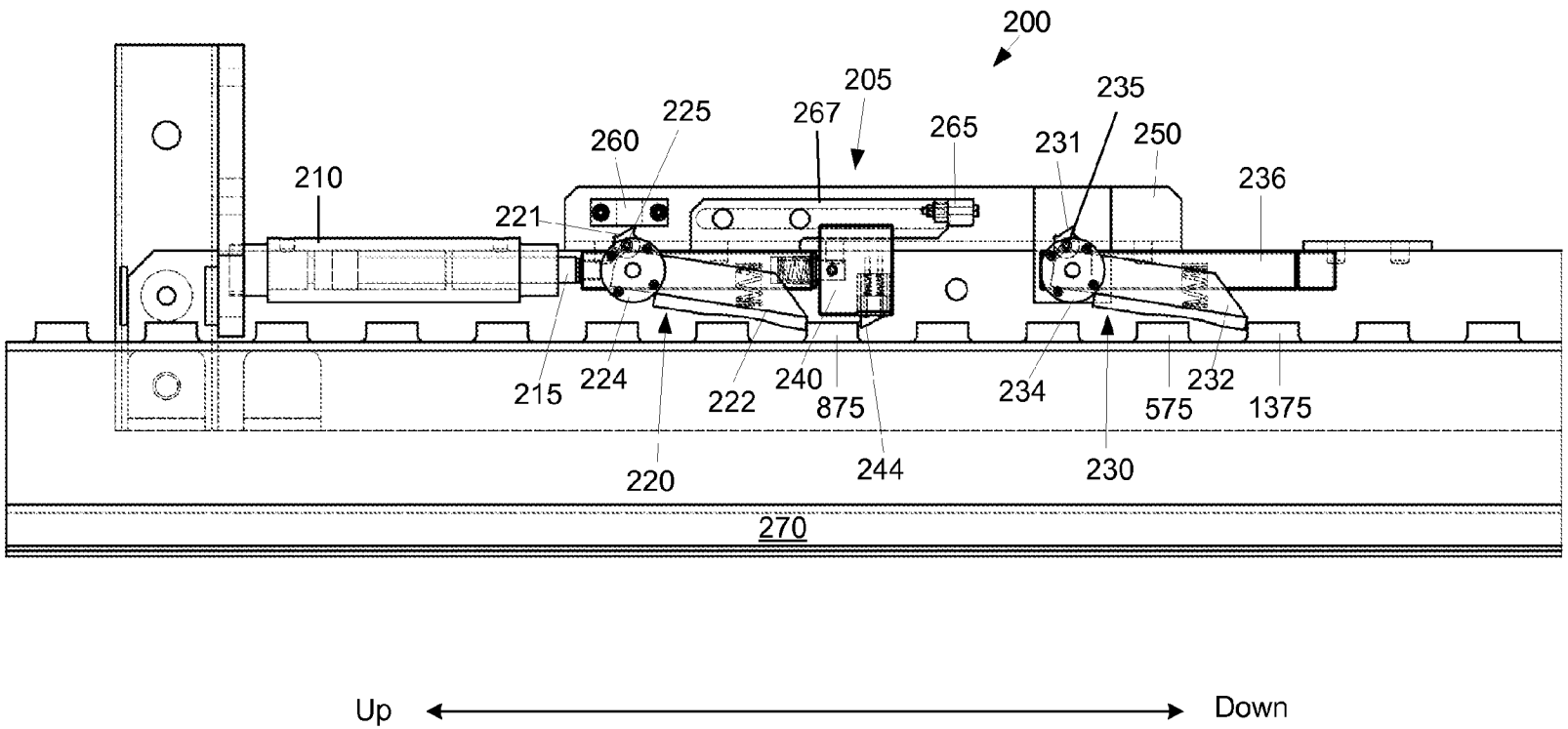

FIG. 13 shows the jack plunger 215 nearly fully retracted. The lower ratchet pawl 232 has engaged with the top edge of a third lug 1375 immediately below the first lug 575. Transferring the weight of the carriage 200 from the upper ratchet pawl 222 to the lower ratchet pawl 232, is shown by block 490 (FIG. 4).

Thereafter, the carriage 200 may continue to descend, as the jack plunger 215 fully retracts and begins to extend again as shown by blocks 430 and 440 (FIG. 4).

Jacking System with Cam Support Assemblies

Figure 14:
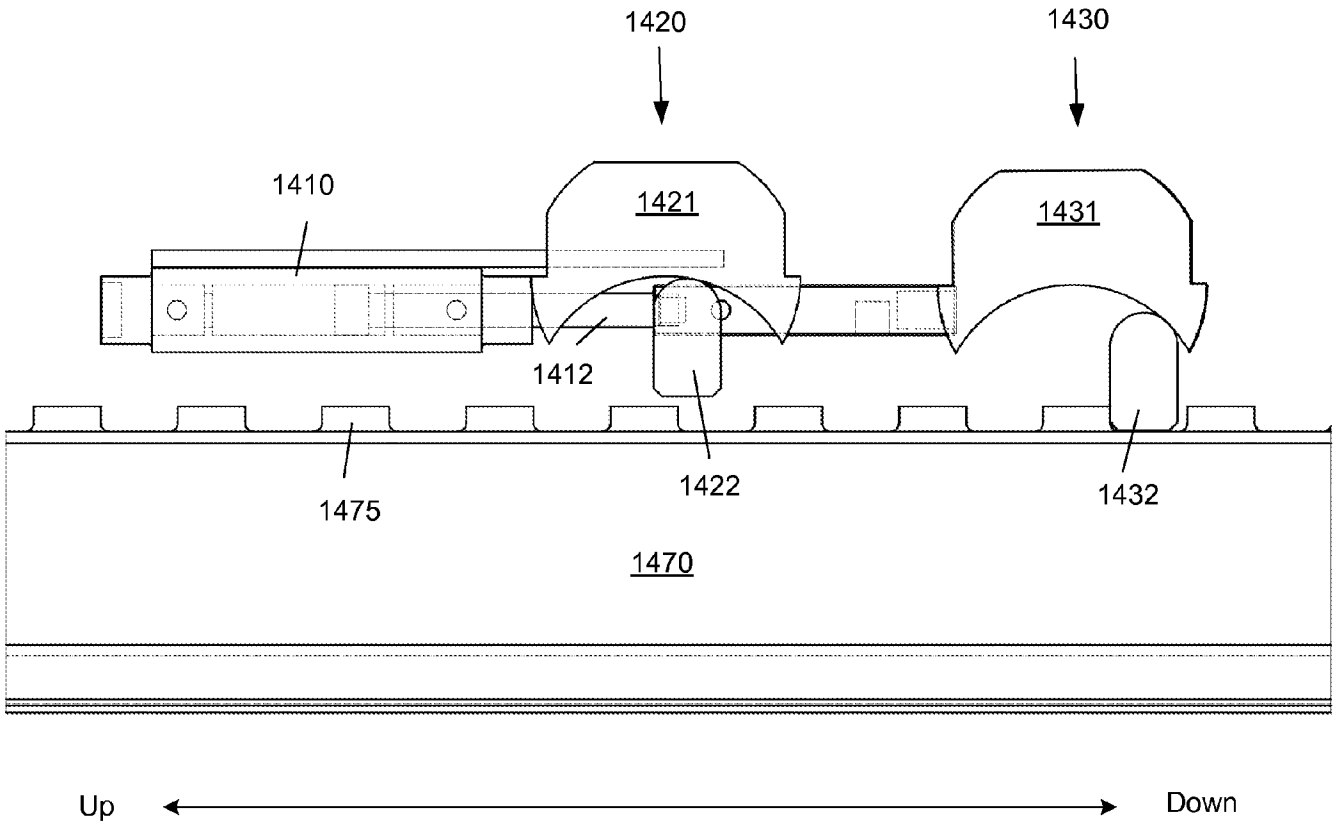
FIG. 14 is a schematic diagram of a third exemplary embodiment of a jacking system.

While the first and second embodiments of the jacking system use spring loaded pawls to engage the lugs, the system may also be implemented using different mechanisms that engage the lugs to bear the weight of the loaded carriage. Under a third exemplary embodiment, as shown in FIG. 14, the weight of a carriage 1400 is alternately supported by an upper support assembly 1420 and a lower support assembly 1430. Each support assembly 1420, 1430 includes a support peg 1422, 1432 that slides up and down relative to a moon cam 1421, 1431 under force from a hydraulic jack 1410.

The relative position of the support peg 1422, 1432 relative to the moon cam 1421, 1431 determines the horizontal displacement of the support peg 1422, 1432 relative to a vertical support 1470 that includes a plurality of evenly spaced lugs 1475. In particular, at the top or bottom of a vertical travel range of the support peg 1422, 1432 relative to the moon cam 1421, 1431, the support peg 1422, 1432 is closest to the vertical support 1470, generally between two lugs 1475, so the support lug 1422, 1432 can support the weight of the carriage 1400. Around the middle of the vertical travel range of the support peg 1422, 1432 relative to the moon cam 1421, 1431, the support peg 1422, 1432 is farthest from the vertical support 1470, allowing the support peg 1422, 1432 to be refracted from the vertical support 1470 and clear the lugs 1475 so the support assembly 1420, 1430 may be move upward or downward relative to the vertical support.

By moving the moon cams 1421, 1431 and or the support pegs 1422, 1432, the upper support peg 1422 and the lower support peg 1432 may alternately bear the weight of the carriage 1400 upon the lugs 1475, while the other support peg 1422, 1432 may be withdrawn from the vertical support 1470 and moved either up or down to an adjacent lug 1475, depending whether the carriage 1400 is ascending or descending.

Additional Embodiments

Additional embodiment of jacking systems according to the present invention are similarly possible, where an upper and lower support assembly alternately supports the weight of a carriage as the other support assembly is moved up or down relative to a vertical support. For example, a step motor system that uses a cylinder with recessed slots may ascend or descend a jack beam. In this example, slots on the cylinder latch onto the beam lugs as the step motor rotates the cylinder either backwards or forwards. Of course, other mechanical and/or electrical mechanical support assemblies may also be used within the scope of this invention.

In summary, it will be apparent to those skilled in the art that various modifications and variations can be made to the structure of the present invention without departing from the scope or spirit of the invention. For example, while the embodiments presented generally disclose applying a downward force upon the sub-carriage, there is no objection to alternative embodiments where an upward force is applied to the carriage or sub-carriage. In view of the foregoing, it is intended that the present invention cover modifications and variations of this invention provided they fall within the scope of the following claims and their equivalents.

What is claimed is:

1. A method for lowering a carriage configured to ascend and descend along a support having a series of lugs disposed upon said support, each lug having a top edge and a bottom edge, the carriage comprising a frame comprising a first ratchet pawl configured to engage said top edges of said series of lugs, a sub-carriage slidably disposed within said frame comprising a second ratchet pawl configured to engage said top edges of said series of lugs, and a plunger configured to apply a downward force upon said sub-carriage, the method comprising the steps of:

engaging said first ratchet pawl with a first lug;

supporting a weight of said carriage with said first ratchet pawl;

retracting said second ratchet pawl from said support;

applying a downward force upon said sub-carriage, causing said sub-carriage to descend with respect to said frame;

engaging said second ratchet pawl upon a second lug;

transferring said weight of said carriage to said second ratchet pawl;

disengaging said first ratchet pawl from said first lug;

retracting said first ratchet pawl away from said support;

relaxing said downward force upon said sub-carriage, thereby lowering said frame; and engaging said first ratchet pawl with a third lug, wherein said third lug is disposed below said first lug.

2. The method of claim 1, further comprising the step of:

applying an upward force to a finger pawl attached to said sub-carriage, wherein said finger pawl is configured to engage a bottom edge one of said series of lugs.

3. A method for lowering a carriage configured to ascend and descend along a support having a series of lugs disposed upon said support, each lug having a top edge and a bottom edge, the carriage comprising a sub-carriage slidably disposed within said carriage, the method comprising the steps of:

engaging said carriage with a first lug top edge;

supporting a weight of said carriage upon said first lug top edge;

applying a downward force to said sub-carriage, causing said sub-carriage to descend with respect to said carriage;

engaging said sub-carriage with a second lug top edge;

transferring said weight of said carriage from said first lug to said second lug; and relaxing said downward force upon said sub-carriage, thereby lowering said carriage with respect to said sub-carriage.

4. The method of claim 3, further comprising the steps of:

releasing said carriage from said first lug top edge;

engaging said carriage with a third lug top edge, wherein said third lug is disposed below said first lug; and releasing said sub-carriage from said second lug top edge.

5. The method of claim 4, further comprising the step of engaging said sub-carriage with the bottom edge of a lug selected from the group consisting of said first lug, said second lug, said third lug, and a fourth lug.

6. The method of claim 5, further comprising the step of releasing said sub-carriage from the bottom edge of said selected lug.

7. A method for raising or lowering a load bearing carriage along a support having a series of lugs disposed upon said support, the carriage comprising a first pawl configured to retractably engage said series of lugs, and a sub-carriage slidably disposed within said carriage comprising a second pawl configured to retractably engage said series of lugs, the method comprising the steps of:

applying a variable magnitude unidirectional force upon said sub-carriage; and configuring said carriage for a descending mode by setting a first trigger causing said first pawl to retract from said support;

setting a second trigger causing said second pawl to retract from said support; and configuring said first trigger and said second trigger to trip based on the location of said sub-carriage relative to said carriage.

8. The method of claim 7, wherein:

said first trigger is tripped when said sub-carriage is at a first location relative to said carriage; and said second trigger is tripped when said sub-carriage is at a second location relative to said carriage.

9. The method of claim 7, further comprising the step of configuring said carriage for an ascending mode by clearing said first trigger and said second trigger.

10. The method of claim 7, wherein said force is applied by a hydraulic jack.

11. The method of claim 7, wherein said force is applied in a substantially parallel direction to a carriage direction of travel.

12. The method of claim 7, wherein said force is applied in a substantially opposite direction from a carriage direction of travel.

13. A carriage configured to ascend and descend along a substantially vertical support having a series of lugs disposed upon said vertical support, each lug of said series of lugs having a top edge and a bottom edge, comprising:

a frame comprising:

a first movable support configured to engage said top edges of said series of lugs;

a sub-carriage slidably disposed within said frame comprising:

a second movable support configured to engage said top edges of said series of lugs;

a first trigger for retracting said first movable support from said series of lugs;

a second trigger for retracting said second movable support from said series of lugs; and a member configured to apply a unidirectional force upon said sub-carriage.

14. The carriage of claim 13, wherein said first movable support comprises a first ratchet pawl, and said second movable support comprises a second ratchet pawl.

15. The carriage of claim 14, wherein said first trigger and said second trigger comprise:

a first trip bar attached to said sub-carriage configured to retract said first ratchet pawl from said series of lugs; and a second trip bar attached to said frame configured to retract said second ratchet pawl from said series of lugs.

16. The carriage of claim 15, wherein said first trigger and said second trigger further comprise:

a first ratchet pawl ear piece configured to engage with said first trip bar; and a second ratchet pawl ear piece configured to engage with said second trip bar, wherein said first ratchet pawl ear piece is disposed upon said first ratchet pawl, and said second ratchet pawl ear piece is disposed upon said second ratchet pawl.

17. The carriage of claim 15, wherein said first trip bar and said second trip bar are removable.

18. The carriage of claim 15, wherein said first trip bar and said second trip bar are configured to selectively retract or not retract said first ratchet pawl and said second ratchet pawl.

19. The carriage of claim 13, wherein said first trigger and said second trigger are configured to be selectively activated.

20. The carriage of claim 13, wherein said member comprises a hydraulic jack.

21. The carriage of claim 13, further comprising a finger pawl configured to engage said bottom edges of said series of lugs.

22. The carriage of claim 21, wherein said finger pawl is removable.

23. The carriage of claim 21, wherein said finger pawl is further configured to not engage said series of lugs in an ascending mode.

24. The carriage of claim 23, further comprising means to alternately engage and disengage said ascending mode.

25. The carriage of claim 13, wherein said unidirectional force has a substantially downward orientation.

26. The carriage of claim 13, wherein said unidirectional force has a substantially upward orientation.

* * * * *